US012025154B2

(12) United States Patent
Yan et al.

(10) Patent No.: US 12,025,154 B2
(45) Date of Patent: Jul. 2, 2024

(54) REFRIGERANT COMPRESSOR INCLUDING DIFFUSER WITH GROOVES

(71) Applicant: DANFOSS A/S, Nordborg (DK)

(72) Inventors: Jin Yan, Tallahassee, FL (US); Kevin Patrick Hartzog, Niceville, FL (US); Tianli Zhang, Ann Arbor, MI (US)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 18/032,854

(22) PCT Filed: Nov. 17, 2021

(86) PCT No.: PCT/US2021/059600

§ 371 (c)(1),
(2) Date: Apr. 20, 2023

(87) PCT Pub. No.: WO2022/119709

PCT Pub. Date: Jun. 9, 2022

(65) Prior Publication Data

US 2023/0400038 A1 Dec. 14, 2023

Related U.S. Application Data

(60) Provisional application No. 63/120,837, filed on Dec. 3, 2020.

(51) Int. Cl.

| | |
|---|---|
| ***F04D 29/44*** | (2006.01) |
| ***F04D 17/10*** | (2006.01) |
| ***F04D 29/66*** | (2006.01) |

(52) U.S. Cl.
CPC ..... *F04D 29/441* (2013.01); *F04D 17/10* (2013.01); *F04D 29/661* (2013.01)

(58) Field of Classification Search
CPC ..... F04D 17/10; F04D 29/441; F04D 29/445; F04D 29/661
See application file for complete search history.

(56) References Cited

U.S. PATENT DOCUMENTS

| | | | | |
|---|---|---|---|---|
| 10,119,554 | B2 * | 11/2018 | Liu | F04D 29/665 |
| 10,385,877 | B2 * | 8/2019 | Kim | F04D 29/284 |
| 11,408,439 | B2 * | 8/2022 | Higashimori | F04D 29/441 |
| 11,828,188 | B2 * | 11/2023 | Japikse | F04D 29/441 |
| 2005/0152786 | A1 * | 7/2005 | Ro | F04D 29/162 416/242 |
| 2011/0219809 | A1 | 9/2011 | Kurihara | |
| 2015/0369073 | A1 * | 12/2015 | Japikse | G06F 30/17 703/2 |
| 2017/0198713 | A1 | 7/2017 | Bessho | |
| 2019/0162462 | A1 | 5/2019 | Kim | |

* cited by examiner

*Primary Examiner* — Sang K Kim
(74) *Attorney, Agent, or Firm* — Carlson, Gaskey & Olds, P.C.

(57) ABSTRACT

A refrigerant compressor according to an exemplary aspect of the present disclosure includes, among other things, a diffuser including grooves configured to resist backflow of refrigerant. The compressor is used in a heating, ventilation, and air conditioning (HVAC) chiller system, for example.

12 Claims, 4 Drawing Sheets

REFRIGERANT COMPRESSOR INCLUDING DIFFUSER WITH GROOVES

RELATED APPLICATIONS

This application claims the benefit of U.S. Provisional Application No. 63/120,837, filed Dec. 3, 2020, the entirety of which is herein incorporated by reference.

TECHNICAL FIELD

This disclosure relates to a refrigerant compressor including a diffuser with grooves. The compressor is used in a heating, ventilation, and air conditioning (HVAC) chiller system, for example.

BACKGROUND

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to compress refrigerant. Refrigerant flows into the impeller in an axial direction, and is expelled radially from the impeller toward a diffuser. Within the diffuser, the refrigerant broadens and reduces its speed, resulting in an increase in pressure.

SUMMARY

A refrigerant compressor according to an exemplary aspect of the present disclosure includes, among other things, a diffuser including grooves configured to resist backflow of refrigerant.

In a further embodiment, the grooves are depressions formed in a wall of the diffuser.

In a further embodiment, the refrigerant compressor includes an impeller and a volute, and the diffuser is radially between the impeller and the volute.

In a further embodiment, each of the grooves includes a radially inner end adjacent the impeller, and a radially outer end adjacent the volute and arranged such that radially outer end is circumferentially spaced-apart from the radially inner end.

In a further embodiment, each groove includes a first curved side wall extending from the radially inner end to the radially outer end, and a second curved side wall extending from the radially inner end to the radially outer end.

In a further embodiment, a depth of each of the grooves is variable along a length of the respective groove.

In a further embodiment, each of the grooves exhibits a maximum depth at a point substantially halfway between the radially inner end and the radially outer end.

In a further embodiment, each of the grooves exhibits a depth that gradually tapers leading away from the maximum depth toward both the radially inner end and the radially outer end.

In a further embodiment, each of the grooves are grooves of a first type, the diffuser includes a plurality of grooves of a second type, and each of the grooves of the second type is a circumferentially-extending groove connecting adjacent grooves of the first type.

In a further embodiment, each of the grooves of the first type exhibits a depth that is variable in a radial direction when viewed in cross-section.

In a further embodiment, radially outward of the grooves of the second type, each of the grooves of the first type is slanted so as to be deeper at a radially inward location, and radially inward of the grooves of the second type, each of the grooves of the first type is slanted so as to be deeper at a radially outward location.

In a further embodiment, the grooves of the second type are slanted so as to be deeper at a radially inward location.

In a further embodiment, the diffuser includes a first wall and a second wall opposite the first wall, and one or both of the first wall and the second all includes the grooves.

A refrigerant system according to an exemplary aspect of the present disclosure includes, among other things, a condenser, an evaporator, an expansion device, and a refrigerant compressor. The refrigerant compressor includes a diffuser including grooves configured to resist backflow of refrigerant.

In a further embodiment, the refrigerant compressor includes an impeller and a volute, the diffuser is radially between the impeller and the volute, and the grooves are depressions formed in a wall of the diffuser.

In a further embodiment, each of the grooves includes a radially inner end adjacent the impeller, a radially outer end adjacent the volute and arranged such that radially outer end is circumferentially spaced-apart from the radially inner end, a first curved side wall extending from the radially inner end to the radially outer end, and a second curved side wall extending from the radially inner end to the radially outer end.

In a further embodiment, a depth of each of the grooves is variable along a length of the respective groove.

In a further embodiment, each of the grooves exhibits a maximum depth at a point substantially halfway between the radially inner end and the radially outer end.

In a further embodiment, each of the grooves are grooves of a first type, the diffuser includes a plurality of grooves of a second type, and each of the grooves of the second type is a circumferentially-extending groove connecting adjacent grooves of the first type.

In a further embodiment, radially outward of the grooves of the second type, each of the grooves of the first type is slanted so as to be deeper at a radially inward location, and, radially inward of the grooves of the second type, each of the grooves of the first type is slanted so as to be deeper at a radially outward location.

DETAILED DESCRIPTION

Figure 1:
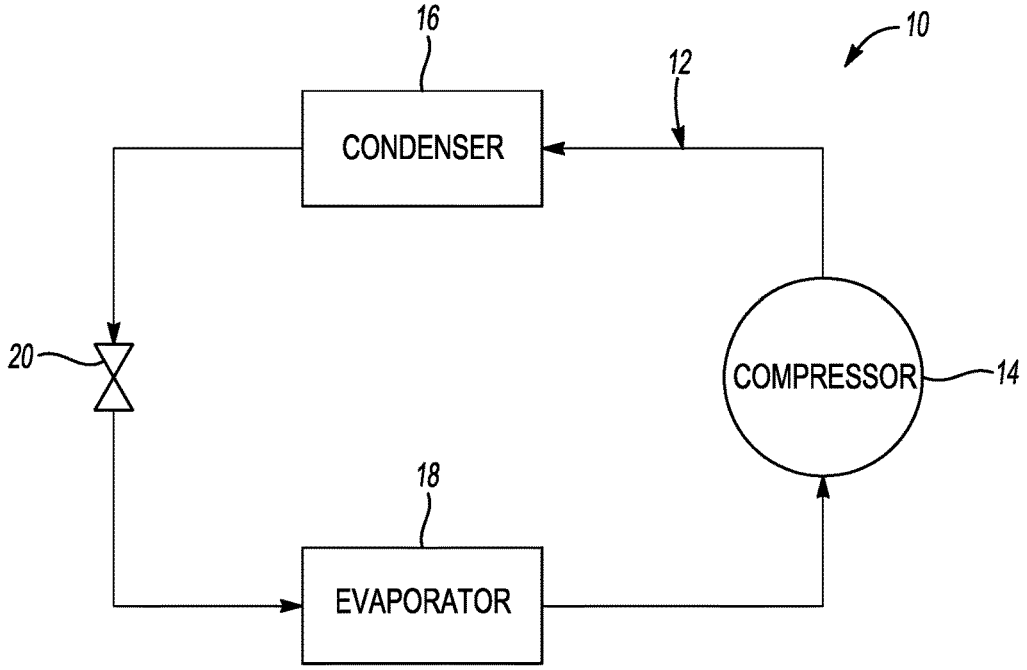
FIG. 1 schematically illustrates a refrigerant system.

FIG. 1 illustrates a refrigerant system 10. The refrigerant system 10 includes a main refrigerant loop, or circuit, 12 in communication with a refrigerant compressor 14, a condenser 16, an evaporator 18, and an expansion device 20. This refrigerant system 10 may be used in a chiller, for example. In that example, a cooling tower may be in fluid communication with the condenser 16. While a particular example of the refrigerant system 10 is shown, this application extends to other refrigerant system configurations, including configurations that do not include a chiller. For instance, the main refrigerant loop 12 can include an economizer downstream of the condenser 16 and upstream of the expansion device 20.

Figure 2:
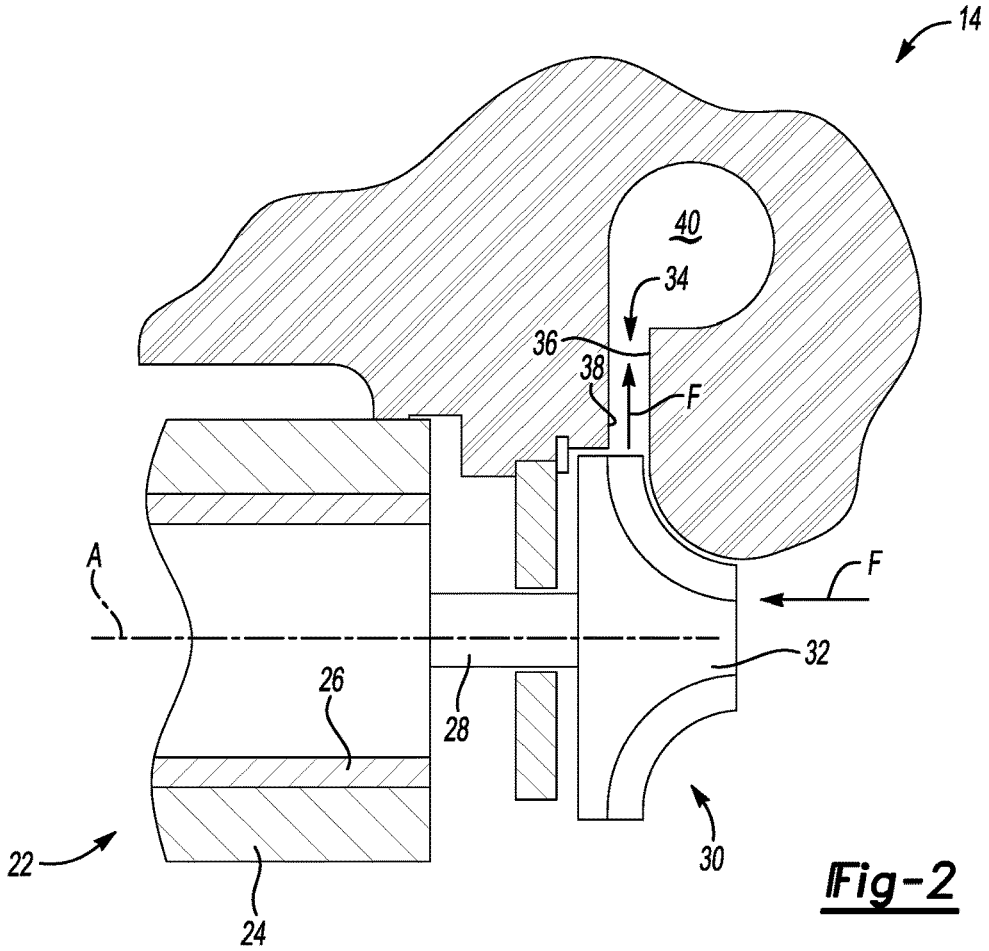
FIG. 2 schematically illustrates a portion of a compressor.

FIG. 2 illustrates, in cross-section, a portion of the compressor 14. The compressor 14 includes an electric motor 22 having a stator 24 arranged radially outside of a rotor 26. The rotor 26 is connected to a shaft 28, which rotates to drive at least one compression stage 30 of the compressor 14, which in this example includes at least one impeller 32. The compressor 14 may include multiple compression stages.

The shaft 28 and impeller 32 are rotatable by the electric motor 22 about an axis A to compress refrigerant F. The terms axial, radial, and circumferential in this disclosure are used relative to the axis A. The shaft 28 may be rotatably supported by a plurality of bearing assemblies, which may be magnetic bearing assemblies.

During operation of the compressor 14, refrigerant F flows axially toward the impeller 32 and is expelled radially outwardly to a diffuser 34 downstream of the impeller 32. The diffuser 34 is a channel arranged axially between a first wall 36 and a second wall 38, and arranged radially between the outlet of the impeller 32 and a volute 40. The volute 40 may be in fluid communication with the condenser 16 or another compression stage of the compressor 14. Within the diffuser 34, refrigerant F expelled by the impeller 32 broadens and reduces in speed, resulting in an increase in pressure of the refrigerant F.

In some operational conditions of the compressor 14, such as when the compressor 14 is operating at relatively low speeds and/or mass flow rates, the compressor 14 may experience an undesirable condition known as surge. Surge refers to a condition in which refrigerant F tends to reverse or flow backwards within the compressor 14.

The diffuser 34 in this disclosure is configured to resist such backflow of refrigerant F within the diffuser 34, and in turn the diffuser 34 resists surge conditions and extends the useful operating range of the compressor 14. In one example, one or both of the first and second walls 36, 38 includes a plurality of grooves. The grooves are depressions formed in the first and/or second walls 36, 38. The first and/or second walls 36, 38 may include multiple similarly-arranged grooves circumferentially spaced-apart from one another about the axis A. Further, each of the first and/or second walls 36, 38 may include more than one type of groove.

Figure 3A:
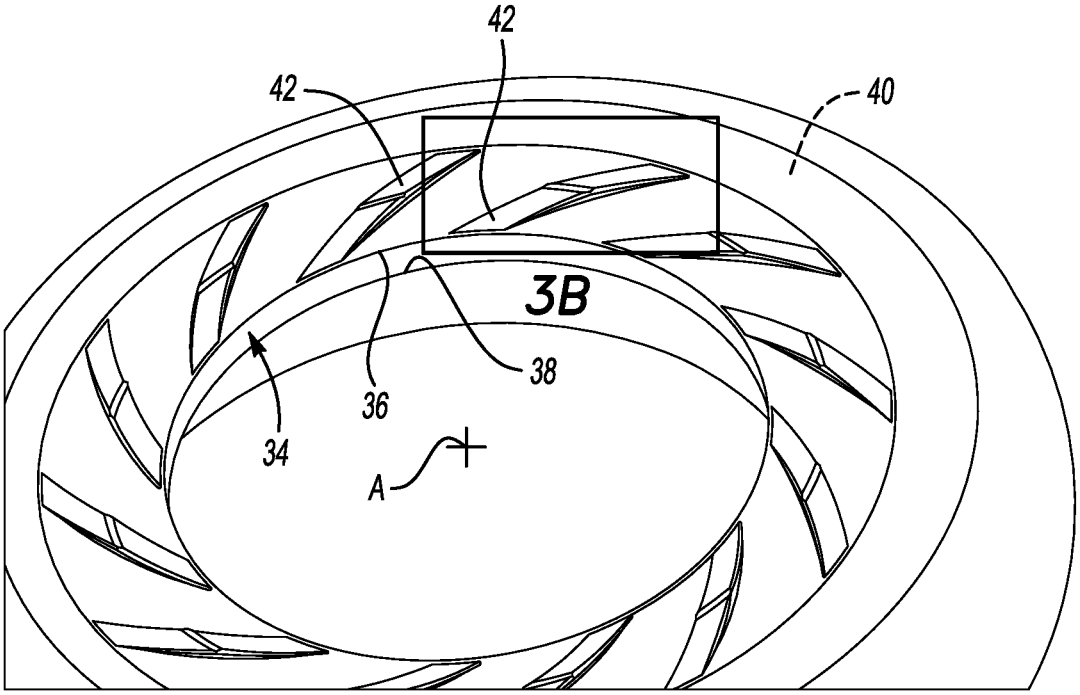
FIG. 3A is a perspective view of a portion an example diffuser arranged relative to a volute.
Figure 3B:
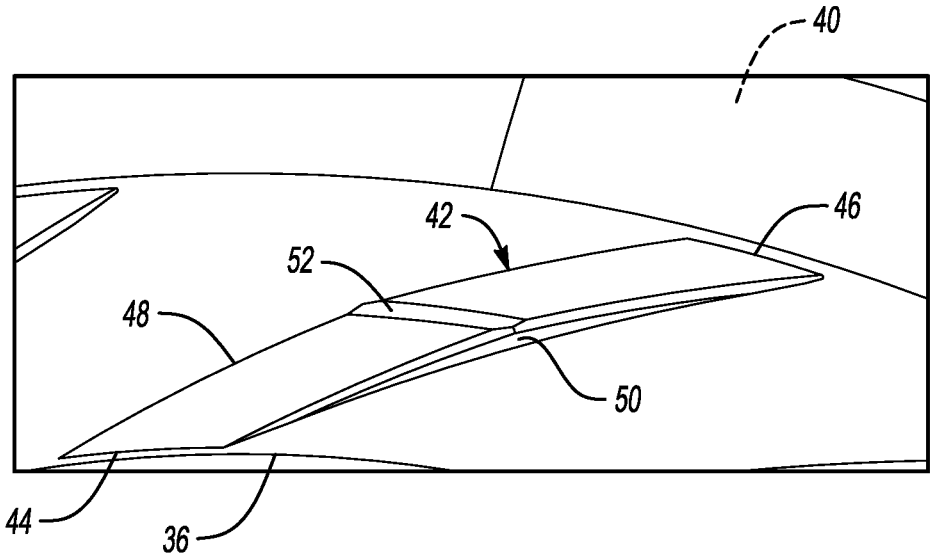
FIG. 3B is a close-up view of a portion of FIG. 3A.

FIGS. 3A and 3B illustrate a first arrangement of grooves 42 relative to the first wall 36. FIGS. 3A and 3B illustrate the grooves 42 from an opposite side of the first wall 36. Thus, the grooves 42 appear as projections in FIGS. 3A and 3B. However, from a perspective of the refrigerant F in the diffuser 34, the grooves 42 are depressions in the first wall 36. In an example, the grooves 42 are formed by being stamped into a metallic sheet forming the first wall 36. The grooves 42 may be formed using other techniques such as milling, casting, additive manufacturing, etc.

With specific reference to FIG. 3B, the grooves 42 extend radially from a radially inner end 44 adjacent the outlet of the impeller 32 to a radially outer end 46 adjacent the volute 40. The grooves 42 are bound on the circumferential sides by first and second side walls 48, 50, which are circumferentially spaced-apart from one another by a constant distance, in this example, along the length of the groove 42. The first and second side walls 48, 50 are curved such that the radially inner end 44 is circumferentially spaced-apart from the radially outer end 46. The curvature of the first and second side walls 48, 50 corresponds to the expected circumferential component of refrigerant F exiting the impeller 32.

Further, a depth of the grooves 42 relative to the adjacent surface of the first wall 36 is variable along the length of the grooves 42 from the radially inner end 44 to the radially outer end 46. In particular, the grooves 42 include a maximum depth at a midpoint 52, which is substantially halfway between the radially inner and outer ends 44, 46. Moving radially away from the midpoint 52, the depth of the grooves 42 gradually tapers toward both the radially inner and outer ends 44, 46, at which points the grooves 42 blend into the first wall 36. This arrangement of the grooves 42 passively resists backflow of the refrigerant F in conditions that otherwise may have led to a surge conditions by reducing swirls in the flow downstream of the impeller. Further, while shown relative to the first wall 36, the second wall 38 could alternatively or additional include similar grooves to those shown and described relative to FIGS. 3A and 3B.

Figure 4A:
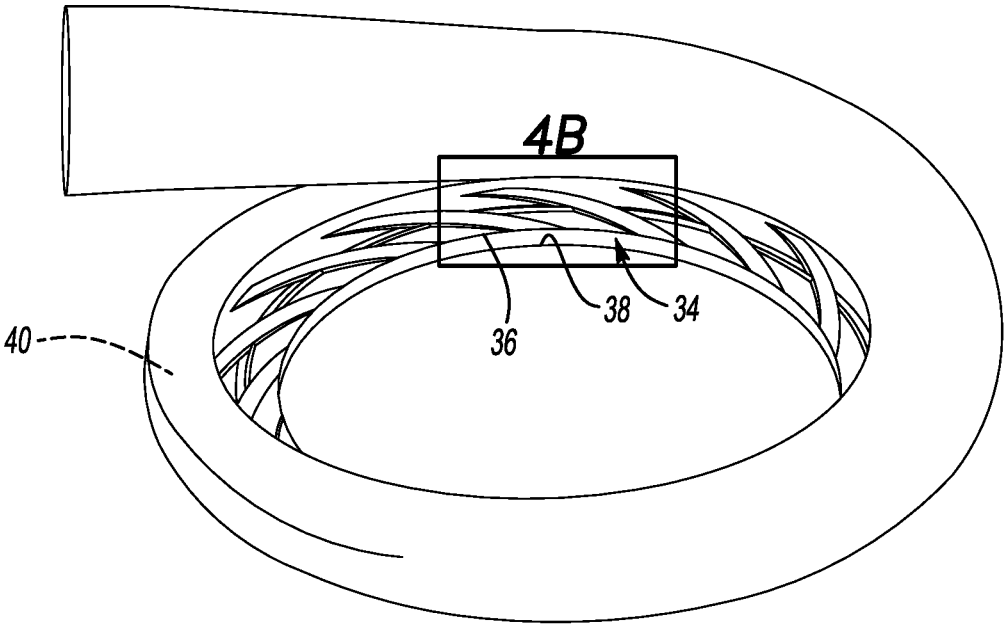
FIG. 4A is a perspective view of a portion of another example diffuser arranged relative to a volute.
Figure 4B:
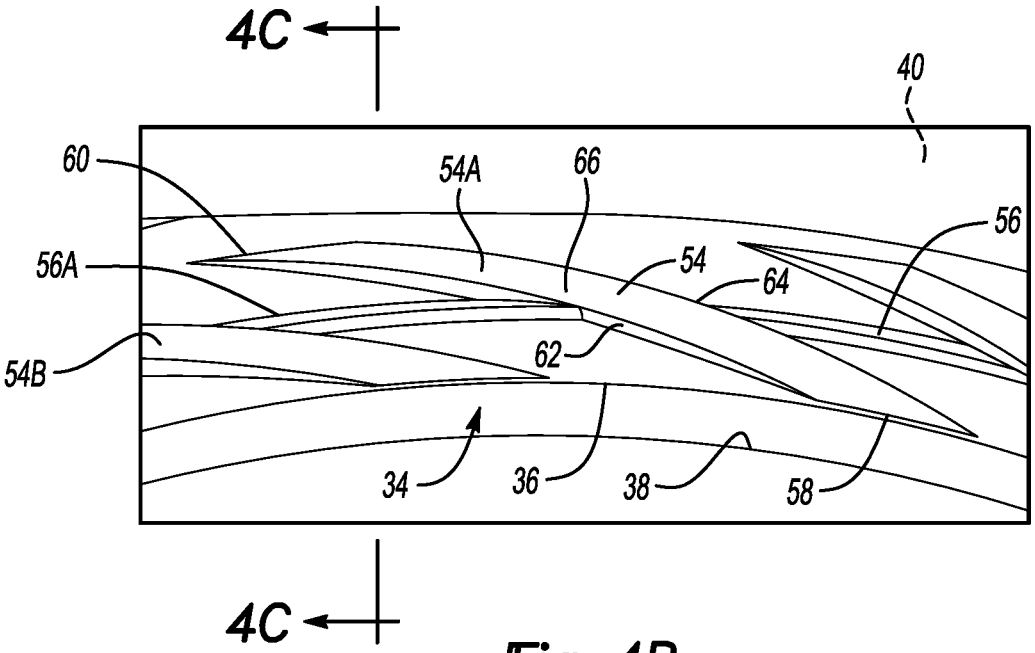
FIG. 4B is a close-up view of a portion of FIG. 4A.
Figure 4C:
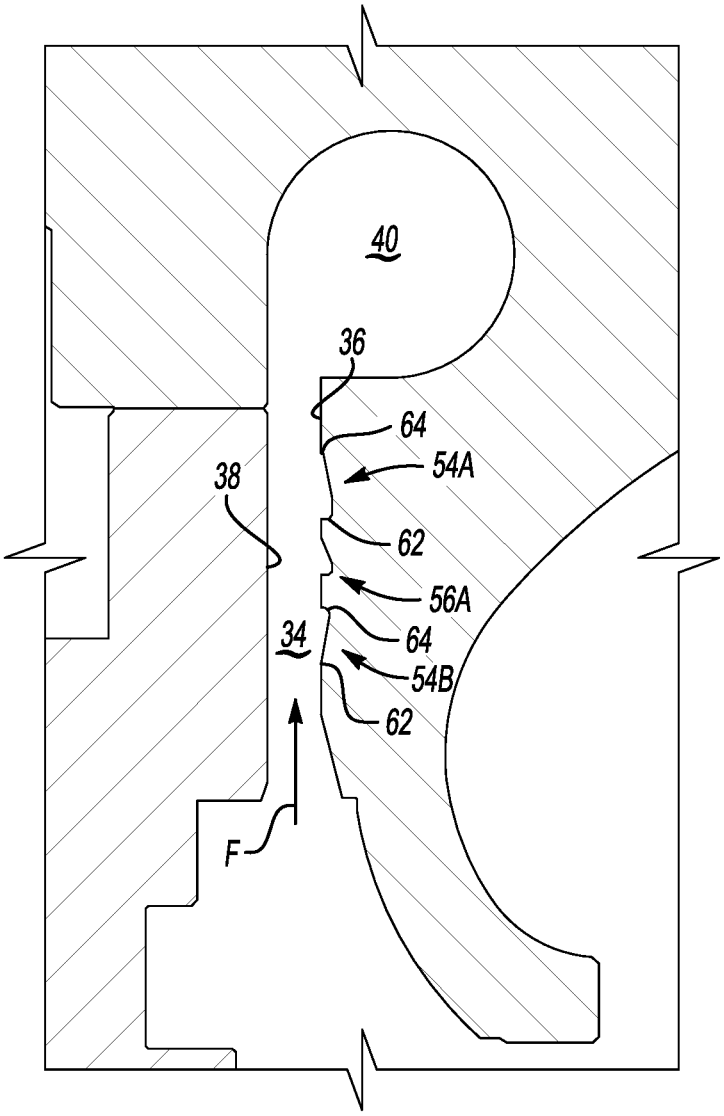
FIG. 4C is a cross-sectional view of the example diffuser and volute taken along line 4C-4C in FIG. 4B.

FIGS. 4A-4C illustrate another example arrangement of grooves. In this example, the first wall 36 includes two different types of grooves. The first type of grooves 54 are substantially similar to the grooves 42. The second type of grooves 56 are circumferentially-extending grooves that connect adjacent grooves 54 of the first type. FIGS. 4A and 4B illustrate the grooves 54, 56 from the opposite side of the first wall 36, as in FIGS. 3A and 3B, such that the grooves 54, 56 appear as projections, yet they are actually depressions from the perspective of the refrigerant F in the diffuser 34.

The first type of grooves 54 extend radially from a radially inner end 58 adjacent the outlet of the impeller 32 to a radially outer end 60 adjacent the volute 40. The grooves 54 are bound on the circumferential sides by first and second side walls 62, 64, which are circumferentially spaced-apart from one another by a substantially constant distance along the length of the grooves 54, in this example. The first and second side walls 62, 64 are curved such that the radially inner end 58 is circumferentially spaced-apart from the radially outer end 60. The curvature of the first and second side walls 62, 64 corresponds to the expected circumferential component of refrigerant F exiting the impeller 32, which, in this example, happens to be the opposite direction as in FIGS. 3A and 3B.

Further, a depth of the grooves 54 relative to the adjacent surface of the first wall 36 is variable moving along the grooves 54 from the radially inner end 58 to the radially outer end 60. In particular, the grooves 54 include a maximum depth at a midpoint 66, and the depth of the grooves 54 gradually tapers toward both the radially inner and outer ends 58, 60, at which points the grooves 54 blend into the first wall 36.

Adjacent the midpoints 66, adjacent grooves 54 are connected by grooves 56. The grooves 56 extend circumferentially about the axis A and permit fluid to flow between adjacent groove 54. For instance, groove 54A (which is one of the grooves 54) is connected to adjacent groove 54B (which is one of the grooves 54) by groove 56A (which is one of the grooves 56). Groove 56A extends from the first side wall 62 of groove 54A to the second side wall of groove 54B. Groove 56A contacts the side walls of the grooves 54A, 54B at the midpoint 66 of the grooves 54A, 54B.

As shown in FIG. 4C, the grooves 54 and the grooves 56 are variable in the radial dimension when viewed in cross-section. For instance, at locations radially outward of the groove 56A, the groove 54A is slanted such that it is deeper at radially inner locations. Specifically, at locations radially outward of the groove 56A, the second side wall 64 is shallower than the first side wall 62. At locations radially inward of the groove 56A, the opposite is true, as can be seen relative to the groove 54B, where the second side wall 64 is deeper than the first side wall 62. The grooves 56 are also of a variable depth in the radial direction. In FIG. 4C, the groove 56A is slanted such that it is deeper at radially inner locations. The groove arrangement in FIGS. 4A-4C passively resists backflow of refrigerant F in conditions that otherwise may have led to a surge condition, as the grooves 54 reduce swirls in the flow downstream of the impeller and the grooves 56 limit recirculated flow from the approaching the area of the impeller. Further, while shown relative to the first wall 36, the second wall 38 could alternatively or additional include similar grooves to those shown and described relative to FIGS. 4A-4C.

The described diffuser may be used with either radial or mixed flow compression stages. A compressor may include one or more of the described diffusers at one or more compression stages.

It should be understood that terms such as "axial" and "radial" are used above with reference to the normal operational attitude of a compressor. Further, these terms have been used herein for purposes of explanation, and should not be considered otherwise limiting. Terms such "generally," "about," and "substantially" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A refrigerant compressor, comprising:

a diffuser including grooves configured to resist backflow of refrigerant, wherein the refrigerant compressor includes an impeller and a volute, wherein the diffuser is radially between the impeller and the volute, wherein each groove includes: (i) a radially inner end adjacent the impeller, and (ii) a radially outer end adjacent the volute and arranged such that radially outer end is circumferentially spaced-apart from the radially inner end, (iii) a first curved side wall extending from the radially inner end to the radially outer end, and (iv) a second curved side wall extending from the radially inner end to the radially outer end, wherein a depth of each of the grooves is variable along a length of the respective groove, and wherein each of the grooves exhibits a maximum depth at a midpoint thereof.

2. The refrigerant compressor as recited in claim 1, wherein the grooves are depressions formed in a wall of the diffuser.

3. The refrigerant compressor as recited in claim 1, wherein the midpoint of each groove is at a point substantially halfway between the radially inner end and the radially outer end.

4. The refrigerant compressor as recited in claim 3, wherein each of the grooves exhibits a depth that gradually tapers leading away from the maximum depth toward both the radially inner end and the radially outer end.

5. The refrigerant compressor as recited in claim 3, wherein the midpoint of each groove is halfway between the radially inner end and the radially outer end.

6. A refrigerant compressor, comprising:

a diffuser including grooves configured to resist backflow of refrigerant;

wherein the refrigerant compressor includes an impeller and a volute, wherein the diffuser is radially between the impeller and the volute, wherein each groove includes: (i) a radially inner end adjacent the impeller, and (ii) a radially outer end adjacent the volute and arranged such that radially outer end is circumferentially spaced-apart from the radially inner end, (iii) a first curved side wall extending from the radially inner end to the radially outer end, and (iv) a second curved side wall extending from the radially inner end to the radially outer end, wherein a depth of each of the grooves is variable along a length of the respective groove, wherein each of the grooves exhibits a maximum depth at a point halfway between the radially inner end and the radially outer end, wherein each of the grooves are grooves of a first type, wherein the diffuser includes a plurality of grooves of a second type, and wherein each of the grooves of the second type is a circumferentially-extending groove connecting adjacent grooves of the first type.

7. The refrigerant compressor as recited in claim 6, wherein each of the grooves of the first type exhibits a depth that is variable in a radial direction when viewed in cross-section.

8. The refrigerant compressor as recited in claim 7, wherein:

radially outward of the grooves of the second type, each of the grooves of the first type is slanted so as to be deeper at a radially inward location, and radially inward of the grooves of the second type, each of the grooves of the first type is slanted so as to be deeper at a radially outward location.

9. The refrigerant compressor as recited in claim 8, wherein the grooves of the second type are slanted so as to be deeper at a radially inward location.

10. The refrigerant compressor as recited in claim 1, wherein:

the diffuser includes a first wall and a second wall opposite the first wall, and one of the first wall and the second wall includes the grooves.

11. A refrigerant system, comprising:

a condenser, an evaporator, an expansion device, and a refrigerant compressor, wherein the refrigerant compressor includes a diffuser including grooves configured to resist backflow of refrigerant, wherein the refrigerant compressor includes an impeller and a volute, wherein the diffuser is radially between the impeller and the volute, wherein the grooves are depressions formed in a wall of the diffuser, wherein each of the grooves includes: (i) a radially inner end adjacent the impeller, (ii) a radially outer end adjacent the volute and arranged such that radially outer end is circumferentially spaced-apart from the radially inner end, (iii) a first curved side wall extending from the radially inner end to the radially outer end, and (iv) a second curved side wall extending from the radially inner end to the radially outer end, wherein a depth of each of the grooves is variable along a length of the respective groove, wherein each of the grooves exhibits a maximum depth at a point halfway between the radially inner end and the radially outer end, wherein each of the grooves are grooves of a first type, wherein the diffuser includes a plurality of grooves of a second type, and wherein each of the grooves of the second type is a circumferentially-extending groove connecting adjacent grooves of the first type.

12. The refrigerant system as recited in elaim 19claim 11, wherein:

radially outward of the grooves of the second type, each of the grooves of the first type is slanted so as to be deeper at a radially inward location, and radially inward of the grooves of the second type, each of the grooves of the first type is slanted so as to be deeper at a radially outward location.

* * * * *